US011801955B2

(12) United States Patent
Vetter et al.

(10) Patent No.: US 11,801,955 B2
(45) Date of Patent: Oct. 31, 2023

(54) DEVICE FOR THE PRODUCTION OF BAGS FILLED WITH INFUSIBLE MATERIAL

(71) Applicant: TEEPACK SPEZIALMASCHINEN GMBH & CO. KG, Meerbusch (DE)

(72) Inventors: Holger Vetter, Korschenbroich (DE); Thomas Heidtmann, Meerbusch (DE)

(73) Assignee: Teepack Spezialmaschinen GmbH & Co. KG, Meerbusch (DE)

( * ) Notice: Subject to any disclaimer, the term of this patent is extended or adjusted under 35 U.S.C. 154(b) by 0 days.

(21) Appl. No.: 17/674,012

(22) Filed: Feb. 17, 2022

(65) Prior Publication Data

US 2022/0258892 A1 Aug. 18, 2022

(30) Foreign Application Priority Data

Feb. 18, 2021 (EP) ..... 21157910

(51) Int. Cl.

| | |
|---|---|
| ***B65B 29/02*** | (2006.01) |
| ***B65B 1/06*** | (2006.01) |
| ***B65B 1/16*** | (2006.01) |

(52) U.S. Cl.

CPC ..... *B65B 29/028* (2017.08); *B65B 1/06* (2013.01); *B65B 1/16* (2013.01)

(58) Field of Classification Search

CPC ..... B65B 29/028

See application file for complete search history.

(56) References Cited

U.S. PATENT DOCUMENTS

| | | | | |
|---|---|---|---|---|
| 4,853,071 | A * | 8/1989 | Romagnoli | B65B 11/40 53/134.2 |
| 2007/0186513 | A1* | 8/2007 | Romagnoli | B65B 9/067 53/562 |
| 2017/0087596 | A1 | 3/2017 | Vasanthan | |
| 2022/0332454 | A1* | 10/2022 | Conti | B65B 29/028 |

FOREIGN PATENT DOCUMENTS

| | | | |
|---|---|---|---|
| EP | 1597148 | B1 | 7/2006 |
| EP | 2052976 | A1 | 4/2009 |
| EP | 1818264 | B1 | 10/2009 |
| EP | 2231479 | B1 | 8/2011 |
| EP | 3140100 | B1 | 1/2018 |
| JP | 2014031993 | A | 2/2014 |
| JP | 2020117271 | A | 8/2020 |
| WO | 2001062600 | A1 | 8/2001 |

OTHER PUBLICATIONS

European Search Report Issued in European Patent Application No. 21157910.7 on Aug. 12, 2021, 10 pages with English translation.

* cited by examiner

*Primary Examiner* — Jason K Niesz
(74) *Attorney, Agent, or Firm* — Dorsey & Whitney LLP

(57) ABSTRACT

The present invention relates to a device for the production of bags (8) filled with infusible material having a base plate (50) which separates a drive side (54) from an operating side (52), where a bag-production device is provided on the operating side (52) in which a batch of the infusible material is placed onto the bag material (25) which is shaped into a tube and the tube sections are processed to form closed bags (8), where the bag production device is provided in a work space (68) between the base plate (50) and at least one protective door (56). In order to improve the cleanliness within the work space, the present invention proposes a ventilation device (74) for generating an air flow in the work space (68).

11 Claims, 4 Drawing Sheets

DEVICE FOR THE PRODUCTION OF BAGS FILLED WITH INFUSIBLE MATERIAL

CROSS REFERENCE TO RELATED APPLICATIONS

This application claims benefit of priority pursuant to 35 U.S.C. § 119(a) of European patent application no. 21157910.7 filed 18 Feb. 2021, which is hereby incorporated herein by reference in its entirety.

The present invention relates to a device for the production of bags filled with infusible material.

The present invention pertains to the field of the production of bags containing infusible material. Such bags are typically produced as tea bags. However, other infusible foods can also be received in the bag.

A device of the kind mentioned above is known for example from EP 1 818 264 B1.

In principle, previously known devices for the production of bags containing infusible material have a front or operating side on which the bag production device is accessible. The device is typically operated on this operating side. Supplies for the consumable materials are typically provided on this side. These consumable materials can be the actual bag material. Furthermore, a roll with thread is provided as a consumable material as well as a roll with a label which is connected to the manufactured bag via the thread. In addition, a supply of film for the production of an aroma packaging surrounding the bag can further be provided. Blanks for cardboard packaging can also be provided as a supply on the front side. A respective flat blank is typically formed into a cardboard box in the device, where side surfaces are adhesively bonded to one another. A stack consisting of a predetermined number of bags is introduced into the cardboard packaging before the cardboard packaging is closed. The solution according to the invention can also correspond to these specifications individually or as a whole.

A previously known device has a bag production device which comprises various components for forming a tube from the supplied bag material after a batch of the infusible material has been placed on the bag material. This tube is separated between the individual batches. The separated length segments are formed into a bag which is closed. In the present invention, this is preferably done in a transport wheel at which the bags are closed at the top and connected to a label, where a thread provided for this purpose is connected at one end to the bag and at its other end to the label. All this typically takes place at different stations of one or more transport wheels. In addition to the transport wheel forming the bag, a label wheel can be provided in which the bag is connected to a label with the top of the bag facing radially outwardly.

In the present invention as well, the bag is typically a double-chamber bag. There are two discrete batches of the infusible material disposed on a length segment of the bag material. A bottom end of the bag is folded between these batches. The free ends of the severed tube section are closed at the top and connected to the label.

The previously known device, like the device according to the present invention, furthermore has a supply of the brewable material The brewable material typically, and also in the invention, drops from this supply into a portioning wheel with which the individual batches are separated in order to deposit the batches on the bag material. The above-mentioned components are provided in a work space that can be closed with a movable protective door on the operating side. This protective door is typically formed by a frame into which a transparent plastic pane is inserted. The protective door can be slidable or pivotable in order to open the work space at the front side so that an operator can reach the individual components and possibly also the consumable materials.

The infusible material is a natural product with a very wide grain size distribution. During production, very small particles can be released into the work space on the front side in an uncontrolled manner. They deposit on surfaces of the bag production device.

Food is processed in the previously known device. Increased cleanliness is required there. In the event of a batch change, the previously processed batch must be prevented from mixing with the new batch. This basically applies even if the different batches are batches of the same infusible material. More importantly however, the device needs to be cleaned if the new batch is used to process an infusible material with a completely different taste than previously.

The present invention aims to contribute to greater cleanliness within the work space.

In this regard, the present invention proposes a device having the features of claim 1.

Provided in this device according to the invention is a ventilation device which generates an air flow in the work space. The air flow is such that the fine particles released into the work space are carried along by the air flow and discharged from the work space. For this purpose, a suction opening is typically provided in the lower region of the work space and is in communication with a blower that can form the ventilation device at least in part. The ventilation device is preferably configured such that air is introduced into the work space via at least one blow opening in the upper region of the work space so that the resulting air flow sweeps over the entire height of the work space. This applies certainly to the height of the work space in which components of the device are provided that release the finest particles of the brewable material to be packaged. For this purpose, several openings can be provided in the upper region of the work space. However, it is there preferable to provide a single suction opening in a central region close to the floor of the work space which discharges the finest particles of the infusible material from the work space which are conveyed by the air flow and additionally by gravity. Air can be actively blown into the work space via the at least one opening. As an alternative or in addition, air from the surroundings can also be drawn into the work space via an intake opening due to the negative pressure generated via the suction opening.

The portioning device, by way of which the batch from the supply is separated and deposited on the bag material, is typically associated with an independent extraction device which extracts the fine dust formed in the portioning device directly at the location where it forms, so that this dust cannot even enter into the work space.

It has been shown that even such ventilation in the form of a constant air flow in the work space can typically not completely prevent the deposition of the finest particles. According to a preferred development and in view of even greater cleanliness in the work space, a blower provided there is proposed. The blower comprises at least one blow opening, preferably in the form of a blow nozzle, which is directed or can be directed towards components of the bag production device. The blower sweeps over at least part of the bag production device. The at least one blow nozzle is preferably directed toward that region of the bag production device on which fine particles of the infusible material preferably deposit. The deposit is whirled up by the blower and removed from the work space by the air flow.

With regard to good accessibility of the individual components of the bag production device, which is essential for repairing damage and for service work, it is proposed according to a preferred development of the present invention to provide the blower to be motor-driven. The blower is accordingly movable. For example, one or more blow nozzles can be guided past various components of the bag production device in order to whirl up particles of the brewable material deposited there and to remove them with the air flow. The blower is preferably movable in such a way that it can be moved to a resting position in which all components of the bag production device are freely accessible when the protective door is open. During operation, the at least one movable blower preferably sweeps over all components of the bag production device on which very fine particles can deposit.

It goes without saying that the at least one blower preferably comprises a plurality of blow nozzles. The blower is preferably driven to be pivotable. In this embodiment, a pipe carrying the blow medium typically forms the pivot axis of the blower. The blow medium is preferably air. Insofar as an air flow is presently geared toward, this is done in view of the fact that air is the preferred medium for ventilation and for blowing off fine particles. Other media are conceivable, but less recommendable for reasons of cost. The same applies to the operation of the blower.

With regard to a high level of cleanliness at the installation site of the device according to the invention, the suction opening mentioned above is preferably in communication with a separator. This separator can be a cyclone in which the particles carried along with the air flow are removed from the air flow. The separator is typically associated with a reservoir for removed particles which is detachably connected to the separator, so that the reservoir can be emptied and, after emptying, can be re-attached to the separator. The reservoir is preferably attached to the separator using a bayonet lock.

The respective separator and preferably also the said reservoir are preferably provided on the drive side.

A panel is preferably provided on the funnel and projects from the at least one protective door in the direction of the work space and covers the edge of the funnel with a small spacing. This prevents particles of the infusible material from being able to deposit between the funnel and the at least one protective door.

The previously mentioned blower is typically provided on the drive side. The suction side of the blower is preferably in communication with the suction opening provided in the lower region of the work space. The pressure side of the blower preferably leads to a switch point which is provided between the blow opening and the separator. An exhaust line is connected to this switch point and leads to an exposed exhaust. In this way, only a partial volume of the extracted volume is fed back into the work space via the at least one blow opening. A silencer is typically associated with the exhaust, possibly also a filter, so that it is reliably prevented that dust from the infusible material gets from the work space into the surroundings. An exposed exhaust is exposed on the outer side of a machine frame of the device.

The work space is preferably defined laterally by two partition wall walls. This results in an almost closed work space which is defined on the rear side by the base plate, on the front side by the at least one protective door, and laterally by the first partition wall and the second partition wall. The underside of the work space is defined by the funnel; the upper side of the work space typically by a cover. The first partition wall comprises at least one bag material opening which is adapted for the passage of a web of bag material. The second partition wall comprises at least one bag opening which is formed to be adapted for the passage of the finished bag. The two partition walls are typically disposed opposite one another. The two partition walls extend in the vertical direction. The work space is defined between the two partition walls. Disposed on the opposite side are supplies for the production of the bags, for example, the supply for bag material, the supply for labels to be connected to the infusion bag, the supply for the bag and the thread to be connected to the label, and possibly a supply for film for the production of an aroma packaging surrounding the bag; cf. EP 1 597 148 B1; EP 3 140 100 B1; EP 2 231 479 B1; WO01/62600 A1.

The respective partition walls have openings for the individual supplies which are configured to be adapted for the passage of the consumable materials. The respective openings surround the consumable materials with little play. The consumable materials are typically fed along the continuum to the work space and cut into sections there.

The lateral partition walls create a work space that is substantially closed off from the surroundings on the operating side between the base plate and the closed protective door. The motors provided in this work space, for example, servomotors and possibly control devices provided for this purpose, are cooled by the ventilation device so that thermal dissipation loss generated by these components is dissipated in the form of heat and the service life of the respective components is increased.

A device which prevents the air flowing in the work space from escaping through the respective passage opening can be associated with an individual passage opening in the partition wall. For this purpose, for example, a separate air flow can be jetted onto the passage opening in a transverse manner and prevent the circulating air from the work space from reaching a storage area for the consumable materials or a product area for discharging the individual finished infusion bags and, possibly, collating stacks of packagings. For this purpose, an air curtain can be provided at at least one of the respective passage openings for the consumable material or the finished bag.

Further details and advantages of the present invention arise from the following description of an embodiment in conjunction with the drawing, in which.

Figure 1:
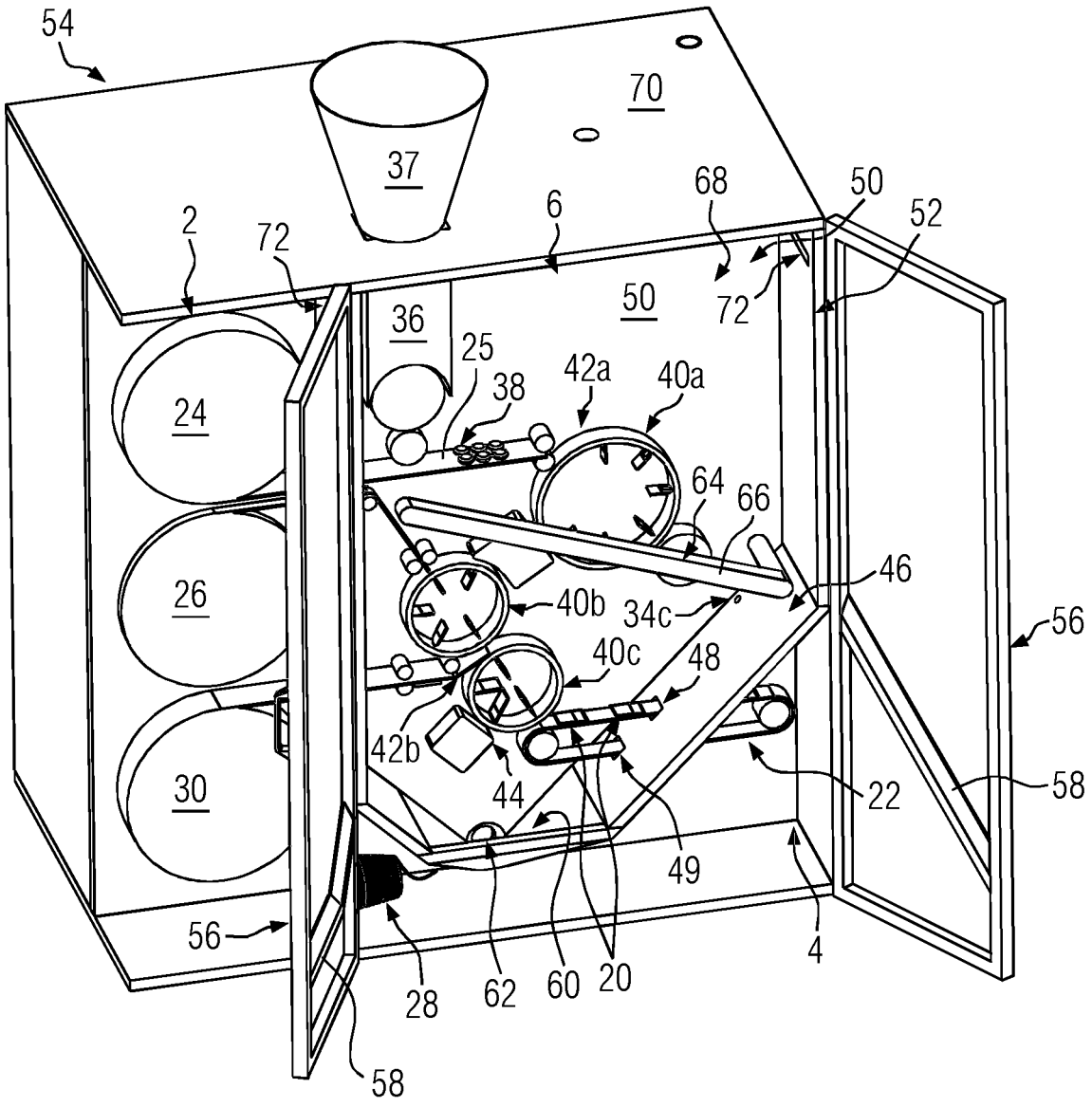
FIG. 1 shows a slightly perspective top view of an operating side of an embodiment of a device for the production of bags filled with infusible material when the protective doors are open.

FIG. 1 shows the top view onto an embodiment of a device for the production of bags filled with infusible material which has substantially three areas, namely a storage area 2 on the left-hand edge, a product area 4 on the right-hand edge, and a work area 6 between the storage area 2 and the product area 4.

Figure 4:
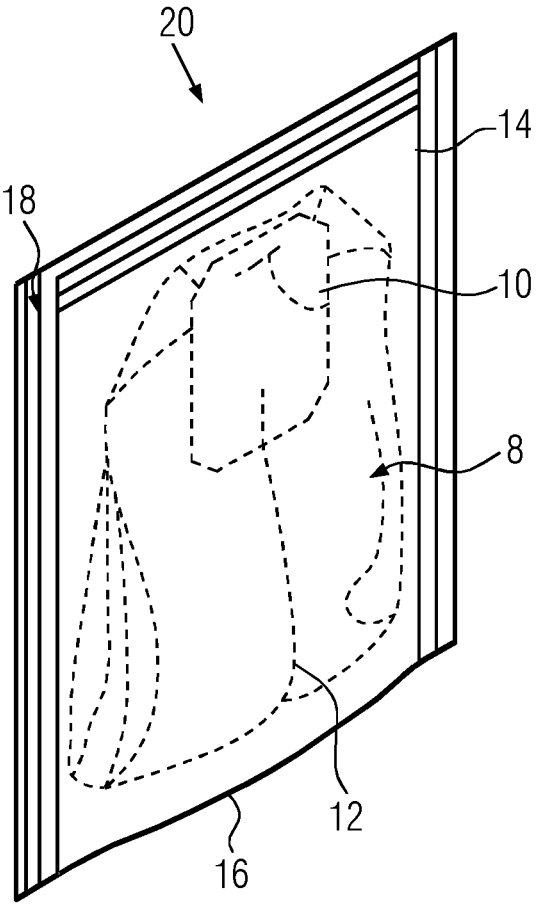
FIG. 4 shows a perspective view of a finished bag produced in the device according to FIGS. 1 to 3.

The bags are produced by removing consumable material from the storage area 2 which are processed to form bags in the work area 6. An example of such a bag is shown in FIG. 4. There the bag is denoted by reference character 8. Reference character 10 denotes a label which is connected to the bag 8 by way of a thread 12. The entity of bag 8, label 10, and thread 12 is received in an aroma packaging 14 which is formed by film material that is impermeable to moisture and that is placed around the bag 8 at an edge 16 and is closed by a U-shaped weld seam 18.

The product shown in FIG. 4 is referred to below as a finished infusion bag 20. The finished infusion bag 20 is moved from the work area 6 to the product area 4 via a conveying line 22.

A supply 24 for bag material 25, a supply 26 for the labels 10, a supply 28 for the thread 12, and a supply 30 for the aroma packaging 14 and which are used as consumable materials in the production of the finished infusion bags 20 can be seen in the storage area 2. These respective consumable materials are each provided on a roll and are rolled off therefrom in the course of production.

The storage area 2 has guides for the individual webs of consumable material. The consumable material is passed through a first partition wall 32 between the storage area 2 and the work area 6. This partition wall 32 comprises various openings, denoted by reference character 34, for the passage of the respective consumable material. The dimensions of the respective opening 34 are selected such that the respective consumable material can barely be passed through the first partition wall 32. Each opening 34 can be associated with an air curtain through which an undesired passage of air from the work area 6 into the storage area 2 or the product area 4 can be prevented. In the embodiment shown, the partition wall 32 defining the work area 6 on the left-hand side comprises an opening 34*a* for the bag material 25, an opening 34*b* for the labels 10, and an opening 34*d* for the aroma packaging 14.

In the working area 6, a batch of the infusible material is placed on the bag material 25 at the height of a portioning device 36 with a supply 37 for infusible material. The bag material 25 is guided on a horizontal stretch 38. After the batch has been placed onto the bag material 25, the latter is shaped into a tube containing the batch. The bag material 25 supplied as endless material is cut into length sections and thus separated. At the end of the horizontal stretch 38, the length sections of the bag material 25 prepared in this manner are transferred to a first transport wheel 40*a*.

At the height of an introduction station 42*a*, the bag material 25 is moved radially inwardly in the direction of the central longitudinal axis or the axis of rotation of the first transport wheel 40*a* in order to form the bag 8 configured as a double-chamber bag. The first transport wheel 40*a* rotates clockwise and feeds the respective bag material 25 to different stations in which the bag is closed at the top and connected to the thread 12 and the label 10.

The bag 8 thus created and processed at the top is transferred from the first transport wheel 40*a* to a second transport wheel 40*b* rotating in the counterclockwise direction, where the bag 8 is pivoted between the two transport wheels 40*a*, 40*b* such that the bottom of the bag 8 is introduced first in the radial direction into the second transport wheel 40*b*. The bag 8 is there connected to the label 10 and is rotated within the second transport wheel 40*b* such that the bottom of the bag 8, which is oriented radially inwardly when introduced, is oriented radially outwardly. In this orientation, i.e. pivoted by 180° relative to the direction of introduction, the bag 8 thus prepared is conveyed out of the second transport wheel 40*b* with the bottom facing forward and fed to a third transport wheel 40*c*. The bag is fed to a wrapping station 42*b* in which the aroma packaging 14 is placed around the bag 8 as well as the label 10 and the thread 12 when the edge 16 is formed. The aroma packaging 14 is then sealed in a sealing station 44 for forming the U-shaped seam 18. The sealing station 44 is associated with a third transport wheel 40*c* on which the bag 8 is held and transported during the sealing process.

The finished bag 20 thus produced is finally placed on the conveying line 22 and fed to the product area 4. For this purpose, a second partition wall 46 comprises a bag passage opening 48 and a return opening 49 for the conveying line 22.

The components previously described as part of the work area 6 are disposed in front of a base plate 50 which carries the individual components and, possibly, separates them from drives that are provided on the oppositely disposed side of the base plate 50. The region of the base plate 50 facing the user separates an operating side 52 provided there from a drive side 54 on the rear side of the device.

Figure 2:
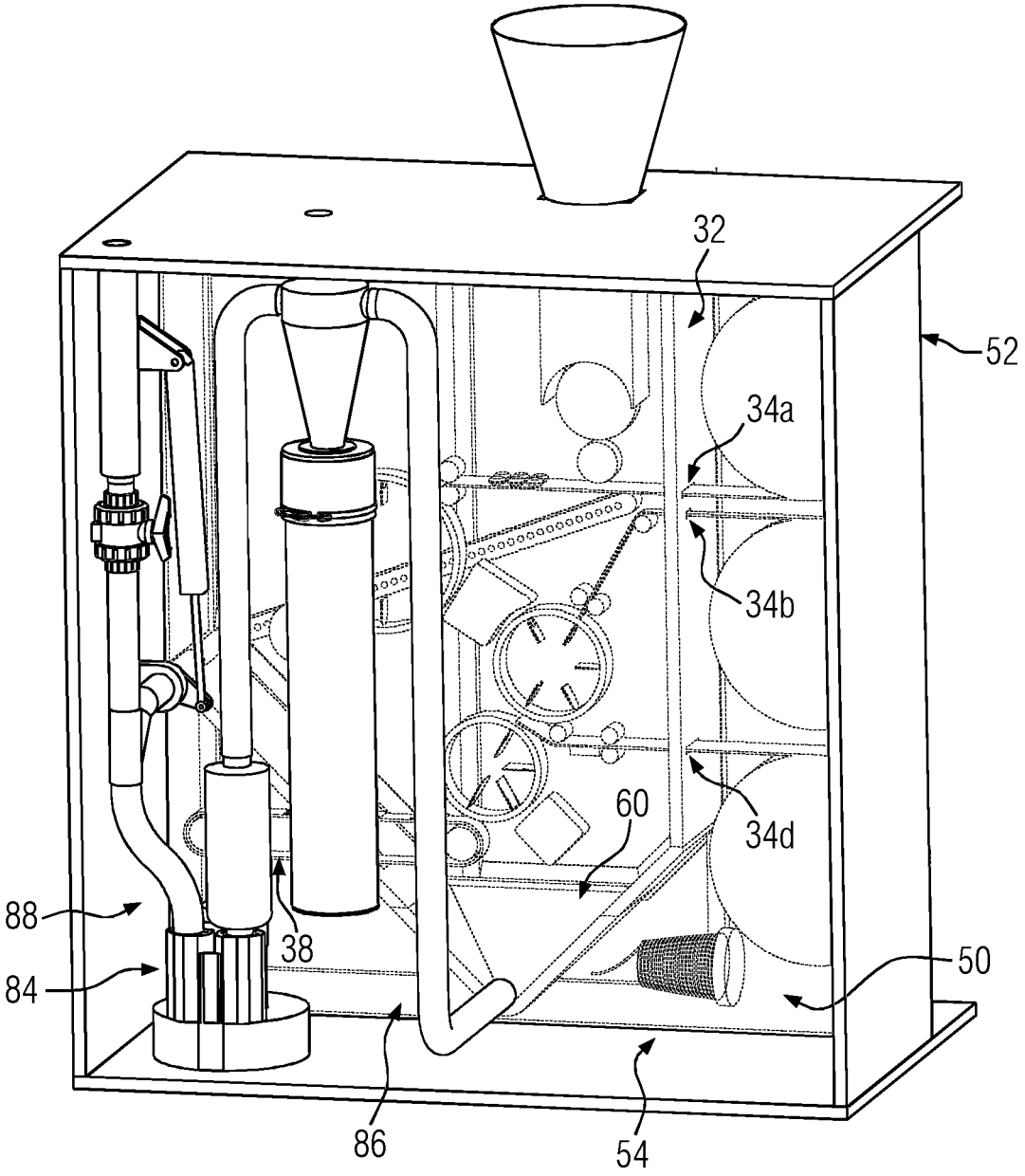
FIG. 2 shows a slightly perspective top view onto a drive side disposed opposite the operating side of the embodiment according to FIG. 1, where components arranged behind a base plate are shown in dashed lines.

FIG. 2 illustrates protective doors 56 which are shown pivoted open in FIG. 2. The protective doors 56 each have a frame which carries a plastic pane that is transparent at least in the upper region. In the lower region, a panel 58 projects from the inner side of the protective door 56. Each panel 58 of the respective protective door 56 is inclined from the outside at an angle downwardly. When the protective door is closed, the edge of a funnel 60, which forms the bottom of the work area and is provided with a suction opening 62 at the center, is located with a corresponding inclination, but with a small height spacing from the panels 58.

Reference character 64 denotes a blower which comprises a pivotable blow arm 66 that comprises a plurality of blow nozzles 67 which are distributed over the length of the blow arm 66 and are oriented towards the base plate 50 (see FIG. 4). The blow arm 66 is driven to be pivotable by a motor and can be pivoted upwardly from the starting position shown in FIG. 2 to an almost vertical orientation. The blow arm 66 there sweeps over the components for the production of the bags 6, such as, for example, the transport wheels 40*a-c* and the components provided in the individual stations 42*a, b*, 44.

The portioning device 36 is typically associated with a separate extraction which acts at the position where the batch is deposited onto the bag material 25 in order not to even let the finest particles of the brewable material get into a work space 68 which, when the protective doors 56 are closed, is formed between them and the base plate 50. This work space 58 is defined laterally by the two partition walls 32, 46, on the underside by the funnel 60, and on the upper side by a cover 70. The work space 68 is substantially closed off from the surroundings. An inclined wall section of the dividing wall 46 on the right-hand side, which continues the inclined surface of the funnel 60, comprises an opening 34*c* for the thread 12 (see FIG. 1)

Provided in the region of the cover 70 in the base plate 50 is a suction opening 72 through which air can be sucked from the surroundings into the work space 68.

During the operation of the device, air is typically continuously sucked into the work space 68 through the suction opening 72 and extracted from the work space 68 through the suction opening 62. This reduces the load of fine dust particles in the work space 68. Provided as an alternative or in addition in the region of the cover 70 can also be at least one blow opening through which air prepared for being blown in through the blow arm 66 is actively blown into the work space 68 from above.

The blow arm 66 is typically pivoted at cyclical intervals and pressurized air is jetted from the blow nozzles 67 onto the components. Dust particles adhering to or deposited on the components are thereby whirled up and extracted by the air flow within the work space 68. When the blower 64 is actuated, the performance of a suction device, via which air is extracted from the suction opening 62 and blown into the work space 68 via the blow nozzles 67, can be increased. When there is an increased quantity of dust particles in the work space 68, the air laden with dust particles in the work space 68 is then also exchanged at an increased rate.

The components causing the air flow, in particular on the rear side of the base plate 60, shall be described hereafter.

Figure 3:
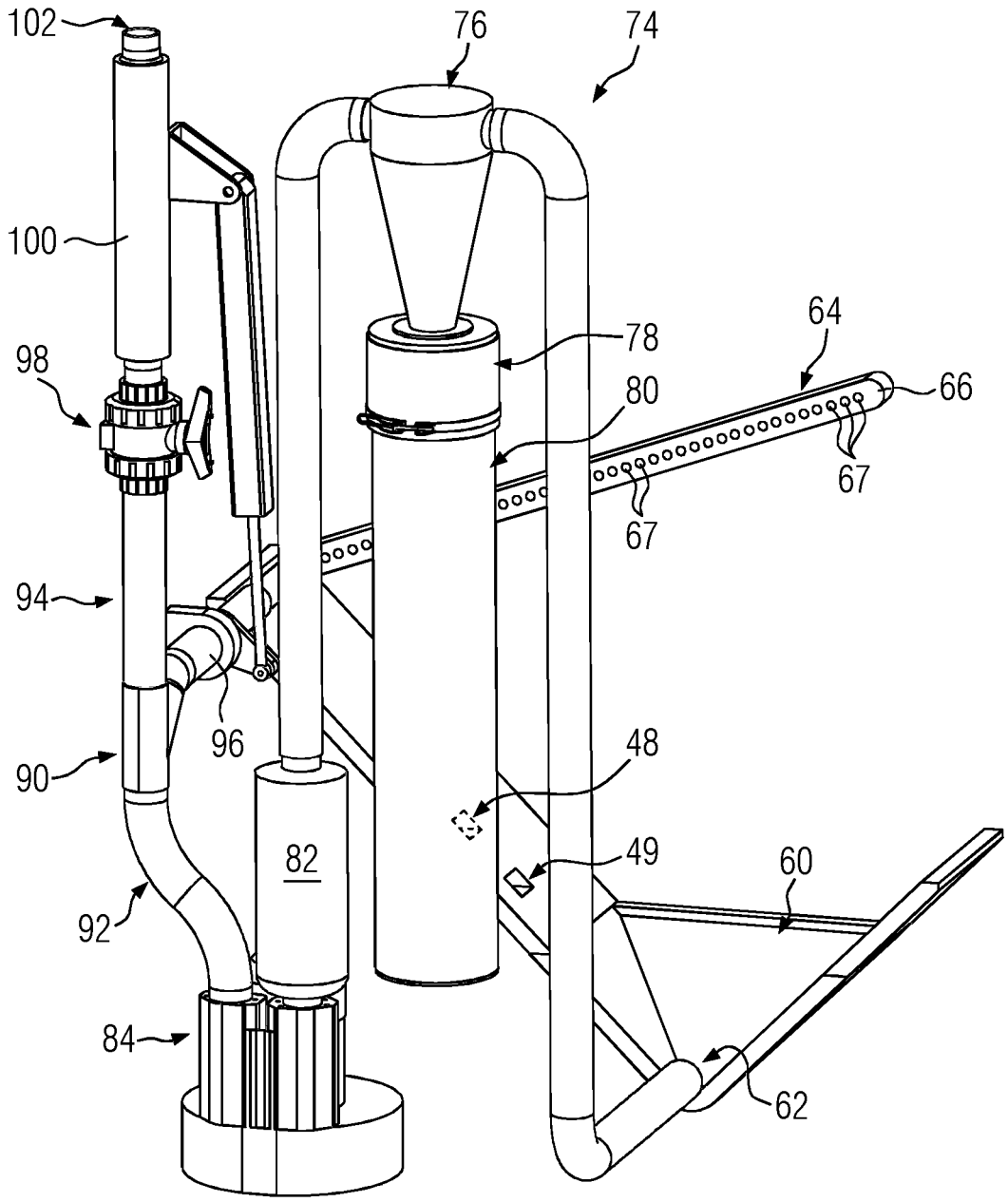
FIG. 3 shows a schematic representation of components for guiding air in the embodiment according to FIG. 1.

In particular, FIGS. 3 and 4 illustrate the ventilation device denoted there with reference character 74. In this embodiment, air is sucked in from the work space 68 through the suction opening 62 and passed over a separator 76 configured as a cyclone which comprises a reservoir 80 for extracted dust particles connected by way of a quick-release fastener 78. The air is passed from the separator 76 via a filter 82 into a side channel blower 84, as an example of a blower. The side channel blower 84 separates a suction side 86 of the ventilation device 74 from a pressure side 88. The air is passed on the pressure side 88 via a blow line 92 to a switch point 90 which is able to divide the air flow so that it is fed selectively either via an exhaust line 94 or a blow arm feed line 96 fed in the direction toward the blow arm 66.

The exhaust line 94 is in communication via a shut-off valve 98 with a silencer 100 which ends at an exposed exhaust 102. The shut-off valve 98 can be adjusted by throttling the line 94 for the manual adjustment of the volume flows that leave the switch point 90 in the direction toward the blow arm feed line 96, on the one hand, and in the direction toward the exhaust line 94, on the other hand. Instead of a shut-off valve, a slide valve can also be installed into the exhaust line 94 as a throttle.

The blow arm 66 in FIGS. 2 to 4 is shown in a central position. The blow arm 66 can be oriented from this position to one extending vertically substantially parallel to a vertically extending section of the second partition wall 46. The blow arm 66 can be oriented downwardly to an orientation substantially parallel to the adjacent surface of the funnel 60. In this way, the blow arm 66 can sweep over all components in the work area 6.

For this pivoting motion, the blow arm 66 is driven by way of a spindle motor, not shown, which engages by way of an eccentric on a pipe that forms the blow arm feed line 96 and that is in communication with the switch point 90 on the input side via a rotary passage.

LIST OF REFERENCE CHARACTERS

2 storage area
4 product area
6 work area
8 bag
10 label
12 thread
14 aroma packaging
16 edge
18 sealing seam
20 finished infusion bag
22 conveying line
24 supply for bag material
25 bag material
26 supply for labels 10
28 supply for thread 12
30 supply for aroma packaging 14
32 first partition wall
34*a* opening for bag material
34*b* opening for labels
34*c* opening for thread
34*d* opening for aroma packaging
36 portioning device
37 supply for infusible material
38 horizontal stretch
40*a* first transport wheel
40*b* second transport wheel
40*c* third transport wheel introduction station
42*b* wrapping station
44 sealing station
46 second partition wall
48 bag passage opening
49 return opening
50 base plate
52 operating side
54 drive side
56 protective door
58 panel
60 funnel
62 suction opening
64 blower
66 blow arm
67 blow nozzles
68 work space
70 cover
72 suction opening
74 ventilation device
76 separator
78 quick release fastener
80 reservoir
82 filter
84 side channel blower
86 suction side
88 pressure side
90 switch point
92 blow line
94 exhaust line
96 blow arm feed line
98 cutoff valve
100 silencer
102 exhaust

The invention claimed is:

1. A device for the production of bags filled with infusible material having a base plate which separates a drive side from an operating side, where a bag production device is provided on said operating side in which a batch of the infusible material is placed onto the bag material which is shaped into a tube and the tube sections are processed to form closed bags, where said bag production device is provided in a work space between said base plate and at least one protective door wherein a ventilation device for generating an air flow in said work space comprises a suction opening provided in a lower region of the work space and in communication with a blower, and an opening upper region of the work space for introducing air in the work space so that the resulting air flow sweeps over the entire height of the work space in which components of the device are provided that release the finest particles of the infusible material to be packaged.

2. The device according to claim 1, further comprising a blower, a suction side of the blower is in communication with the suction opening and a pressure side of the blower is connected to a blow line which is in communication with at least one blow opening that opens into said work space.

3. The device according to claim 2, further comprising a switch point which is connected between a separator and said blow opening to said blow line and to which an exhaust line is connected which leads to an exposed exhaust.

4. The device according to claim 1, wherein that said work space is defined laterally by a first partition wall and a second partition wall, where said first partition wall comprises at least one bag material opening that is formed to be adapted for the passage of the web of said bag material and where said second partition wall is provided disposed opposite said first partition wall and comprises a bag passage opening that is formed to be adapted for the passage of said finished bag.

5. The device according to claim 4, further comprising a supply for said bag material, a supply for labels to be connected to said bags in said work space, a supply for a thread connecting said label to said bag, and optionally a supply for film for the production of an aroma packaging surrounding said bag, where said supplies are provided on the side of said first and/or second partition wall facing away from said work space.

6. The device according to claim 1, wherein the blower is provided in said work space.

7. The device according to claim 6, wherein that said blower is movable in a motor-driven manner in said work space.

8. The device according to claim 7, wherein that said blower comprises a blow arm driven to be pivotable and which comprises a plurality of blow openings formed to be nozzle-shaped.

9. The device according to claim 1, further comprising a funnel, with which the suction opening is associated, wherein the suction opening is in communication with a separator and the funnel is provided below said bag production device.

10. The device according to claim 9, wherein that said separator is provided on said drive side.

11. The device according to claim 9, wherein that said protective door comprises a panel which projects into said work space and projects beyond an edge of said funnel with a small spacing.

* * * * *